US012623280B2

(12) United States Patent
Wu et al.

(10) Patent No.: US 12,623,280 B2
(45) Date of Patent: May 12, 2026

(54) DIE-CASTING ALUMINUM ALLOY WITHOUT HEAT-TREATMENT AND PREPARATION METHOD AND APPLICATION THEREOF

(71) Applicant: XIAOMI EV TECHNOLOGY CO., LTD., Beijing (CN)

(72) Inventors: Xinxing Wu, Beijing (CN); Dong Yang, Beijing (CN); Yongchang Bai, Beijing (CN)

(73) Assignee: XIAOMI EV TECHNOLOGY CO., LTD., Beijing (CN)

( * ) Notice: Subject to any disclaimer, the term of this patent is extended or adjusted under 35 U.S.C. 154(b) by 378 days.

(21) Appl. No.: 18/203,542

(22) Filed: May 30, 2023

(65) Prior Publication Data

US 2024/0139803 A1 May 2, 2024

(30) Foreign Application Priority Data

Oct. 31, 2022 (CN) ..... 202211350885.9

(51) Int. Cl.

| | |
|---|---|
| ***B22D 21/00*** | (2006.01) |
| ***C22C 1/02*** | (2006.01) |
| ***C22C 1/03*** | (2006.01) |
| ***C22C 21/02*** | (2006.01) |

(52) U.S. Cl.

CPC ..... *B22D 21/007* (2013.01); *C22C 1/026* (2013.01); *C22C 1/03* (2013.01); *C22C 21/02* (2013.01)

(58) Field of Classification Search

CPC ..... B22D 21/007; B22D 21/04; B22D 17/00; C22C 1/026; C22C 1/03; C22C 21/02; C22C 1/06; C22F 1/043

See application file for complete search history.

(56) References Cited

U.S. PATENT DOCUMENTS

2006/0027291 A1* 2/2006 Matsuoka ..... C22C 21/08 148/550

FOREIGN PATENT DOCUMENTS

| | | | | |
|---|---|---|---|---|
| CN | 105441737 A | * | 3/2016 | |
| CN | 107923004 A | | 4/2018 | |
| CN | 113039302 A | | 6/2021 | |
| WO | WO-2020018477 A1 | * | 1/2020 | ..... C22C 21/12 |

OTHER PUBLICATIONS

CN-105441737-A, machine translation. (Year: 2016).*
WO-2020018477-A1, machine translation. (Year: 2020).*
Chinese Patent Application No. 202211350885.9, Office Action dated Dec. 14, 2022, 8 pages.
Chinese Patent Application No. 202211350885.9, English translation of Office Action dated Dec. 14, 2022, 15 pages.

* cited by examiner

*Primary Examiner* — John A Hevey
(74) *Attorney, Agent, or Firm* — Cozen O'Connor

(57) ABSTRACT

A die-casting aluminum alloy without heat-treatment and a preparation method and application thereof. Based on a total weight of the die-casting aluminum alloy, the die-casting aluminum alloy includes: 6.0 to 8.0 wt % of Si; 0.3 to 1.2 wt % of Mg; 0.4 to 0.8 wt % of Cu; 0.1 to 0.3 wt % of Fe; 0.6 to 0.8 wt % of Mn; 0.05 to 0.20 wt % of Ti; 0.03 to 0.07 wt % of Sr; 0.03 to 0.07 wt % of Ce; 0.01 to 0.04 wt % of La; 0.01 to 0.1 wt % of Zr; less than or equal to 0.01 wt % of other impurity elements; and a balance of Al.

20 Claims, 4 Drawing Sheets

DIE-CASTING ALUMINUM ALLOY WITHOUT HEAT-TREATMENT AND PREPARATION METHOD AND APPLICATION THEREOF

CROSS-REFERENCE TO RELATED APPLICATIONS

This application is based upon and claims priority to Chinese Patent Application No. 202211350885.9, filed Oct. 31, 2022, the entire contents of which are incorporated herein by reference.

TECHNICAL FIELD

The present disclosure relates to the technical field of aluminum alloys, and more particularly, to a die-casting aluminum alloy without heat-treatment and a preparation method and application thereof.

BACKGROUND

Reducing the weight of automobile is of great significance for promoting energy saving and emission reduction. Aluminum alloy has a high specific strength and is an ideal material for realizing the lightweight of automobiles. As the amount of aluminum alloys used in automobiles increases, the splicing process of structural body parts has become more difficult and less efficient. The development of high-performance die-casting aluminum alloys and the realization of integrated die-casting of structural body parts may break through this bottleneck.

In making die-casting aluminum alloys for automotive structural body parts, the subsequent heat treatment may cause dimensional deformation and surface defects of automotive structural parts. Therefore, large integrated die-casting components are currently mainly made of traditional Al—Si alloy without heat-treatment. However, the comprehensive mechanical properties of the traditional Al—Si alloys are poor, so it is urgent to develop a high-performance die-casting aluminum alloy without heat-treatment for automotive structural body parts.

SUMMARY

According to a first aspect of embodiments of the present disclosure, there is provided a die-casting aluminum alloy without heat-treatment, Based on a total weight of the die-casting aluminum alloy, the die-casting aluminum alloy includes: 6.0 to 8.0 wt % of Si; 0.3 to 1.2 wt % of Mg; 0.4 to 0.8 wt % of Cu; 0.1 to 0.3 wt % of Fe; 0.6 to 0.8 wt % of Mn; 0.05 to 0.20 wt % of Ti; 0.03 to 0.07 wt % of Sr; 0.03 to 0.07 wt % of Ce; 0.01 to 0.04 wt % of La; 0.01 to 0.1 wt % of Zr; less than or equal to 0.01 wt % of other impurity elements; and a balance of Al.

According to a second aspect of embodiments of the present disclosure, there is provided a method for preparing the die-casting aluminum alloy without heat-treatment. The method includes: melting aluminum in a smelting furnace, adding thereto silicon, magnesium, a Cu raw material, a Fe raw material and an Mn raw material, and performing first smelting to obtain a first melt; transferring the first melt to a converter after the first melt is cooled down, adding a first material at a bottom of the first melt, and performing second smelting and first degassing, refining and deslagging to obtain a second melt; transferring the second melt to a holding furnace for component testing after the second melt is cooled down, and performing high-pressure die-casting on the second melt qualified after the component testing to obtain the die-casting aluminum alloy. The first material includes a Ti raw material, a Sr raw material, a Ce raw material, a La raw material, a Zr raw material and a Sn raw material, or the first material includes the Ti raw material, the Sr raw material, the Ce raw material, the La raw material and the Zr raw material.

According to a third aspect of embodiments of the present disclosure, there is provided a structural part of an automobile body, which includes a die-casting aluminum alloy, and the die-casting aluminum alloy is the aforementioned die-casting aluminum alloy without heat-treatment, or the die-casting aluminum alloy without heat-treatment prepared by the aforementioned preparation method.

It is to be understood that both the foregoing general description and the following detailed description are illustrative and explanatory only and are not restrictive of the disclosure, as claimed.

BRIEF DESCRIPTION OF THE DRAWINGS

The accompanying drawings are used to provide a further understanding of the present disclosure, constitute a part of this specification, and serve to explain the present disclosure together with the following descriptions, but do not constitute a limitation on the present disclosure.

DETAILED DESCRIPTION

Figure 1:
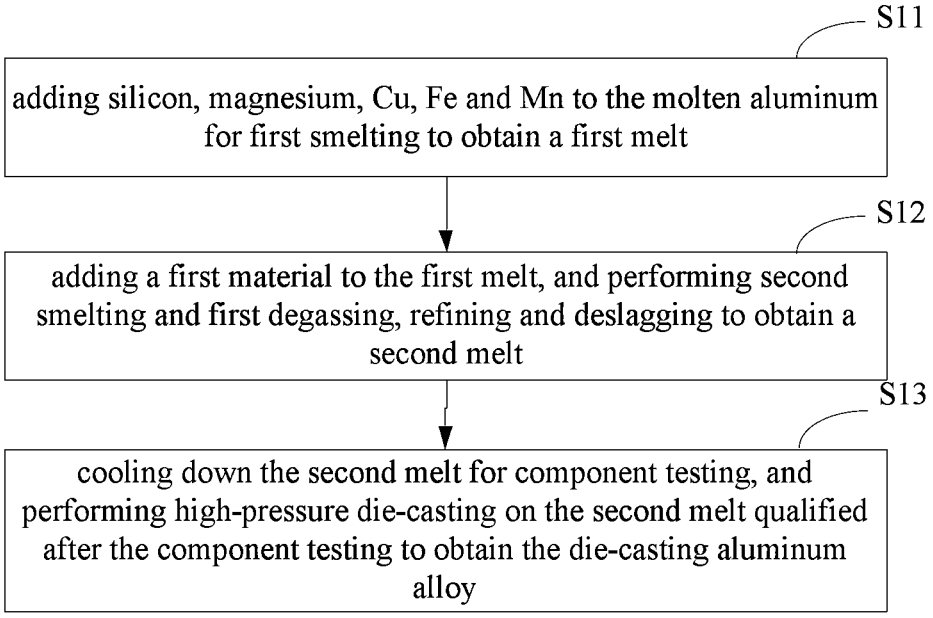
FIG. 1 is a process flow chart illustrating a preparation method of a die-casting aluminum alloy without heat-treatment according to embodiments of the present disclosure.

Descriptions will be made in detail below with reference to embodiments of the present disclosure. It should be understood that, the embodiments described herein are only used to illustrate and explain the present disclosure, and are not intended to limit the present disclosure.

Embodiments of the present disclosure are to provide a die-casting aluminum alloy without heat-treatment, which enhances the strength of the aluminum alloy by strengthening a phase and increases the plasticity of the aluminum alloy.

According to a first aspect of embodiments of the present disclosure, there is provided a die-casting aluminum alloy without heat-treatment, Based on a total weight of the die-casting aluminum alloy, the die-casting aluminum alloy includes: 6.0 to 8.0 wt % of Si; 0.3 to 1.2 wt % of Mg; 0.4 to 0.8 wt % of Cu; 0.1 to 0.3 wt % of Fe; 0.6 to 0.8 wt % of Mn; 0.05 to 0.20 wt % of Ti; 0.03 to 0.07 wt % of Sr; 0.03 to 0.07 wt % of Ce; 0.01 to 0.04 wt % of La; 0.01 to 0.1 wt % of Zr; less than or equal to 0.01 wt % of other impurity elements; and a balance of Al.

In some embodiments, based on the total weight of the die-casting aluminum alloy, the die-casting aluminum alloy includes: 6.0 to 8.0 wt % of Si; 0.3 to 0.9 wt % of Mg; 0.4 to 0.8 wt % of Cu; 0.1 to 0.3 wt % of Fe; 0.65 to 0.75 wt % of Mn; 0.05 to 0.20 wt % of Ti; 0.03 to 0.07 wt % of Sr; 0.03 to 0.07 wt % of Ce; 0.01 to 0.04 wt % of La; 0.01 to 0.1 wt % of Zr; less than or equal to 0.01 wt % of other impurity elements; and a balance of Al.

In some embodiments, the die-casting aluminum alloy further includes 0.05 to 0.15 wt % of Sn based on the total weight of the die-casting aluminum alloy.

In some embodiments, in the die-casting aluminum alloy, the mass ratio of Sn to Fe is not greater than 1.0, the mass ratio of Mn to Fe is not less than 3.0, and the mass ratio of Ce to La is not less than 2.0.

In some embodiments, the die-casting aluminum alloy has an ultimate tensile strength of 300 to 350 MPa, a yield strength of 150 to 180 MPa, an elongation at break of 11.0 to 16.0%, and a bending angle of 23.0 to 27.0° at a section thickness of 3.2 mm.

According to a second aspect of embodiments of the present disclosure, there is provided a method for preparing the die-casting aluminum alloy without heat-treatment. The method includes: melting aluminum in a smelting furnace, adding thereto silicon, magnesium, a Cu raw material, a Fe raw material and an Mn raw material, and performing first smelting to obtain a first melt; transferring the first melt to a converter after the first melt is cooled down, adding a first material at a bottom of the first melt, and performing second smelting and first degassing, refining and deslagging to obtain a second melt; transferring the second melt to a holding furnace for component testing after the second melt is cooled down, and performing high-pressure die-casting on the second melt qualified after the component testing to obtain the die-casting aluminum alloy. The first material includes a Ti raw material, a Sr raw material, a Ce raw material, a La raw material, a Zr raw material and a Sn raw material, or the first material includes the Ti raw material, the Sr raw material, the Ce raw material, the La raw material and the Zr raw material.

In some embodiments, the Cu raw material is an Al—Cu alloy; the Fe raw material is an Al—Fe alloy; the Mn raw material is an Al—Mn alloy; the Ti raw material is an Al—Ti alloy; the Sr raw material is an Al—Sr alloy; the Ce raw material is an Al—Ce alloy; the La raw material is an Al—La alloy; the Zr raw material is an Al—Zr alloy; and the Sn raw material is an Al—Sn alloy.

In some embodiments, the Al—Cu alloy is an Al-50Cu master alloy; the Al—Fe alloy is an Al-5Fe master alloy; the Al—Mn alloy is an Al-20Mn master alloy; the Al—Ti alloy is an Al-5Ti master alloy; the Al—Sr alloy is an Al-5Sr master alloy; the Al—Ce alloy is an Al-10Ce master alloy; the Al—La alloy is an Al-10La master alloy; the Al—Zr alloy is an Al-5Zr master alloy; and the Al—Sn alloy is an Al-125n master alloy.

In some embodiments, a smelting temperature of the smelting furnace is 740 to 760° C.; a transfer temperature of the converter is 710 to 730° C.; and a holding temperature of the holding furnace is 690 to 710° C.

In some embodiments, the first degassing, refining and deslagging includes: adding refining agent powders into a furnace body of the converter under an atmosphere of an inert gas or nitrogen, the inert gas is argon, and the holding temperature of the holding furnace is 690 to 710° C.

In some embodiments, a condition of the high-pressure die-casting includes: a pressure of 26 to 70 MPa, an injection speed of 5.5 to 7.0 m/s, and a die-casting temperature of 690 to 710° C.

In some embodiments, the method further includes: drying the aluminum, the silicon, the magnesium, the Cu raw material, the Fe raw material, the Mn raw material, the Ti raw material, the Sr raw material, the Ce raw material, the La raw material, the Zr raw material and the Sn raw material before the melting or the smelting steps, and the drying is performed at a temperature of 150 to 200° C.

According to a third aspect of embodiments of the present disclosure, there is provided a structural part of an automobile body, which includes a die-casting aluminum alloy, and the die-casting aluminum alloy is the aforementioned die-casting aluminum alloy without heat-treatment, or the die-casting aluminum alloy without heat-treatment prepared by the aforementioned preparation method.

The die-casting aluminum alloy without heat-treatment provided according to embodiments of the present disclosure has significantly improved ultimate tensile strength, yield strength and elongation at break as compared with those of an existing alloy for automobile structural parts, and is suitable for producing large structural thin-wall parts of a new energy electric automobile body.

According to a first aspect of embodiments of the present disclosure, there is provided a die-casting aluminum alloy without heat-treatment. Based on a total weight of the die-casting aluminum alloy, the die-casting aluminum alloy includes: 6.0 to 8.0 wt % of Si; 0.3 to 1.2 wt % of Mg; 0.4 to 0.8 wt % of Cu; 0.1 to 0.3 wt % of Fe; 0.6 to 0.8 wt % of Mn; 0.05 to 0.20 wt % of Ti; 0.03 to 0.07 wt % of Sr; 0.03 to 0.07 wt % of Ce; 0.01 to 0.04 wt % of La; 0.01 to 0.1 wt % of Zr; less than or equal to 0.01 wt % of other impurity elements; and a balance of Al.

The die-casting aluminum alloy without heat-treatment provided according to embodiments of the present disclosure has significantly improved ultimate tensile strength, yield strength and elongation at break as compared with those of an existing alloy for automobile structural parts, and is suitable for producing large structural thin-wall parts of a new energy electric automobile body.

Addition of Si element in the die-casting aluminum alloy without heat-treatment of the present disclosure can not only increase the strength of the alloy, but also ensure the casting fluidity of the alloy. A part of the added Mg and Cu elements will dissolve into the matrix under the condition of die casting to increase the strength of the matrix, and another part will precipitate an intermediate phase at a eutectic region to enhance a bonding strength of the eutectic structure. The added Mn element can replace Fe element, which can reduce the harm of a Fe-rich phase to a certain extent, and the Mn element with a moderately large size helps to improve the mold release performance of the alloy. The Ti and Zr elements added in the die-casting aluminum alloy without heat-treatment of the present disclosure serve as heterogeneous nucleation particles, which increase the nucleation of primary (Al) grains and realize grain refinement, while the content of the Ti and Zr added is excessive, the nucleation particles are coarsened, the refining effect is weakened, and the performance is degraded. The Sr element can transform the eutectic Si from lamellar to fine granular, thereby improving the plasticity of the alloy. Rare earth metals Ce and La are mainly enriched at a grain boundary in the aluminum alloy to eliminate the harmful effects of impurity elements, and interact with other alloy elements to form compounds so as to change the structure of the alloy. Addition of Ce element to Al—Si alloy can form a harder $AlCeSi_2$ phase, thereby further improving the strength of the alloy.

In an embodiment of the present disclosure, based on the total weight of the die-casting aluminum alloy, the die-casting aluminum alloy includes: 6.0 to 8.0 wt % of Si; 0.3 to 0.9 wt % of Mg; 0.4 to 0.8 wt % of Cu; 0.1 to 0.3 wt % of Fe; 0.65 to 0.75 wt % of Mn; 0.05 to 0.20 wt % of Ti; 0.03 to 0.07 wt % of Sr; 0.03 to 0.07 wt % of Ce; 0.01 to 0.04 wt % of La; 0.01 to 0.1 wt % of Zr; less than or equal to 0.01 wt % of other impurity elements; and a balance of Al. The above recipe can increase the plasticity of the alloy and improve the strength of the alloy through grain refinement/structure modification.

In an embodiment of the present disclosure, based on the total weight of the die-casting aluminum alloy, the die-casting aluminum alloy includes: 6.0 to 8.0 wt % of Si; 0.3 to 1.2 wt % of Mg; 0.4 to 0.58 wt % of Cu; 0.1 to 0.3 wt % of Fe; 0.6 to 0.75 wt % of Mn; 0.05 to 0.20 wt % of Ti; 0.03 to 0.07 wt % of Sr; 0.03 to 0.07 wt % of Ce; 0.01 to 0.04 wt % of La; 0.01 to 0.1 wt % of Zr; less than or equal to 0.01 wt % of other impurity elements; and a balance of Al.

In an embodiment of the present disclosure, wherein based on the total weight of the die-casting aluminum alloy, the die-casting aluminum alloy includes: 6.0 to 8.0 wt % of Si; 0.3 to 0.9 wt % of Mg; 0.4 to 0.58 wt % of Cu; 0.1 to 0.3 wt % of Fe; 0.65 to 0.69 wt % of Mn; 0.05 to 0.20 wt % of Ti; 0.03 to 0.07 wt % of Sr; 0.03 to 0.07 wt % of Ce; 0.01 to 0.04 wt % of La; 0.01 to 0.1 wt % of Zr; less than or equal to 0.01 wt % of other impurity elements; and a balance of Al.

The inventors of the present disclosure have found that the Sn element can be combined with β-AlFeSi in the alloy to precipitate as a slag during smelting of the alloy to purify the melt; in addition, the tiny particles serve as crystal nucleus of heterogeneous nucleation during the crystallization process to refine the grains. In an embodiment of the present disclosure, the die-casting aluminum alloy further includes 0.05 to 0.15 wt % of Sn based on the total weight of the die-casting aluminum alloy. There is a coherent interface between a β-Sn phase and a β-AlFeSi phase in the alloy, and the β-Sn phase and the β-AlFeSi phase in the melt form a high-density (β-Sn+β-AlFeSi) joiner. Due to the larger atomic mass as compared with the aluminum melt, the new joiner will settle at the bottom of the melt during the melting process, so as to achieve the effect of purifying the melt, thereby reducing the content of the needle-like β-AlFeSi phase in the die casting, and improving the performance of the alloy. In some embodiments, in the die-casting aluminum alloy, the mass ratio of Sn to Fe is not greater than 1.0, the mass ratio of Mn to Fe is not less than 3.0, and the mass ratio of Ce to La is not less than 2.0.

Figure 5:
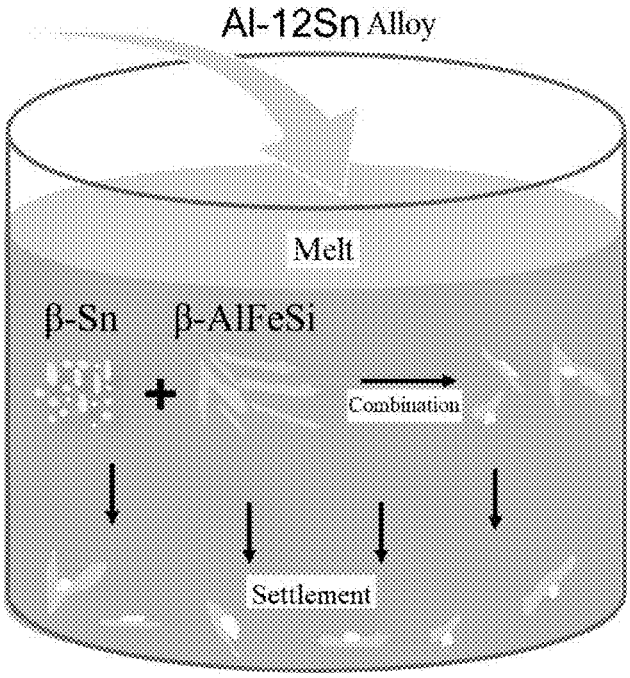
FIG. 5 is a schematic diagram illustrating an iron removal mechanism according to embodiments of the present disclosure.

FIG. 5 is a schematic diagram illustrating an iron removal mechanism with the addition of Sn. When an Al-125n master alloy is added to the alloy, β-Sn particles appear in the melt. Since there is a coherent relationship in the interface between the β-Sn phase and the β-AlFeSi phase, β-Sn and β-AlFeSi will be preferentially combined to form a new joiner. Since the new joiner has a larger mass than the aluminum melt, it settles at the bottom of the melt to achieve the effect of reducing the content of β-AlFeSi in the melt. After a high-pressure die-casting process, the content of the needle-like β-AlFeSi phase in the die-casting is greatly reduced, which reduces the stress concentration during the service of the die casting and achieves the purpose of improving the performance of the alloy.

According to embodiments of the present disclosure, the die-casting aluminum alloy has an ultimate tensile strength of 300 to 350 MPa, a yield strength of 150 to 180 MPa, an elongation at break of 11.0 to 16.0%, and a bending angle of 23.0 to 27.0° at a section thickness of 3.2 mm. The die-casting aluminum alloy without heat-treatment according to embodiments of the present disclosure meets the performance requirements of the automobile industry on structural parts, and is suitable for producing large structural thin-wall parts of an automobile body.

According to a second aspect of embodiments of the present disclosure, there is provided a method for preparing the die-casting aluminum alloy without heat-treatment. The method includes: melting aluminum in a smelting furnace, adding thereto silicon, magnesium, a Cu raw material, a Fe raw material and an Mn raw material, and performing first smelting to obtain a first melt; transferring the first melt to a converter after the first melt is cooled down, adding a first material at a bottom of the first melt, and performing second smelting and first degassing, refining and deslagging to obtain a second melt; transferring the second melt to a holding furnace for component testing after the second melt is cooled down, and performing high-pressure die-casting on the second melt qualified after the component testing to obtain the die-casting aluminum alloy. The first material includes a Ti raw material, a Sr raw material, a Ce raw material, a La raw material, a Zr raw material and a Sn raw material, or the first material includes the Ti raw material, the Sr raw material, the Ce raw material, the La raw material and the Zr raw material.

The method for preparing the die-casting aluminum alloy according to embodiments of the present disclosure can achieve excellent performance without a heat treatment process, which not only solves the problem of deformation and air bubbles in castings caused by the heat treatment, but also help simplify the integrated die-casting process and improve yield.

According to embodiments of the present disclosure, the Cu raw material may be an Al—Cu alloy; the Fe raw material may be an Al—Fe alloy; the Mn raw material may be an Al—Mn alloy; the Ti raw material may be an Al—Ti alloy; the Sr raw material may be an Al—Sr alloy; the Ce raw material may be an Al—Ce alloy; the La raw material may be an Al—La alloy; the Zr raw material may be an Al—Zr alloy; and the Sn raw material may be an Al—Sn alloy.

In an embodiment of the present disclosure, the Al—Cu alloy is an Al-50Cu master alloy; the Al—Fe alloy is an Al-5Fe master alloy; the Al—Mn alloy is an Al-20Mn master alloy; the Al—Ti alloy is an Al-5Ti master alloy; the Al—Sr alloy is an Al-5Sr master alloy; the Al—Ce alloy is an Al-10Ce master alloy; the Al—La alloy is an Al-10La master alloy; the Al—Zr alloy is an Al-5Zr master alloy; and the Al—Sn alloy is an Al-125n master alloy.

According to embodiments of the present disclosure, a smelting temperature of the smelting furnace may be 740 to 760° C.; a transfer temperature of the converter may be 710 to 730° C.; and a holding temperature of the holding furnace may be 690 to 710° C.

According to embodiments of the present disclosure, the first degassing, refining and deslagging may include: adding refining agent powders into a furnace body of the converter under an atmosphere of an inert gas or nitrogen, and the inert gas is argon.

According to embodiments of the present disclosure, a condition of the high-pressure die-casting may include: a pressure of 26 to 70 MPa, an injection speed of 5.5 to 7.0 m/s, and a die-casting temperature of 690 to 710° C.

In an embodiment of the present disclosure, the method further includes: drying the aluminum, the silicon, the magnesium, the Cu raw material, the Fe raw material, the Mn raw material, the Ti raw material, the Sr raw material, the Ce raw material, the La raw material, the Zr raw material and the Sn raw material before the melting or the smelting steps, and the drying is performed at a temperature of 150 to 200° C.

According to a third aspect of embodiments of the present disclosure, there is provided a structural part of an automobile body, which includes a die-casting aluminum alloy, and the die-casting aluminum alloy is the aforementioned die-casting aluminum alloy without heat-treatment, or the die-casting aluminum alloy without heat-treatment prepared by the aforementioned method.

The present disclosure is further described in detail through examples below. The raw materials used in the examples are commercially available.

Example 1

The die-casting aluminum alloy without heat-treatment for structural parts of the automobile body prepared in this example has the following chemical components: 7.32 wt % of Si; 0.49 wt % of Mg; 0.58 wt % of Cu; 0.18 wt % of Fe; 0.69 wt % of Mn; 0.15 wt % of Ti; 0.05 wt % of Sr; 0.05 wt % of Ce; 0.02 wt % of La; 0.04 wt % of Zr; less than or equal to 0.01 wt % of other impurity elements; and a balance of Al.

The preparation of the die-casting aluminum alloy without heat-treatment and a die-casting process thereof in this example include the following steps:

1) Material preparation: raw materials were weighed according to the alloy composition and dried. The raw materials used include Al, Si, Mg, an Al-50Cu master alloy, an Al-5Fe master alloy, an Al-20Mn master alloy, an Al-5Ti master alloy, an Al-5Sr master alloy, an Al-10Ce master alloy, an Al-10La master alloy and an Al-5Zr master alloy.
2) Smelting: a smelting furnace was heated to 750° C. to melt the Al, and then the Si, the Mg, the Al-50Cu master alloy, the Al-5Fe master alloy and the Al-20Mn master alloy were added thereto, after these master alloys were melted, the obtained melt was transferred to a converter with a constant temperature of 730° C.; then the Al-5Ti master alloy, the Al-5Sr master alloy, the Al-10Ce master alloy, the Al-10La master alloy and the Al-5Zr master alloy were added, after these master alloys were melted, high-purity nitrogen was introduced into the resulting melt, and refining agent powders were brought into the melt, ventilating for 15 minutes for degassing and deslagging. Afterwards the melt was left to stand for 12 minutes, and then transferred to a holding furnace with a constant temperature of 690° C. for pre-furnace composition analysis.
3) Die-casting: the melt with a temperature of 690° C. was transferred to an LK630T horizontal cold chamber die-casting machine for high-pressure die-casting after passing the composition test. The casting pressure is 301V1 Pa, the injection speed is 6.5 m/s, the mould temperature is 200° C., and the mould used is a flat mould with a length of 30 cm and a width of 20 cm.

Example 2

The die-casting aluminum alloy without heat-treatment for structural parts of the automobile body prepared in this example has the following chemical components: 7.32 wt % of Si; 0.49 wt % of Mg; 0.58 wt % of Cu; 0.18 wt % of Fe; 0.69 wt % of Mn; 0.15 wt % of Ti; 0.05 wt % of Sr; 0.05 wt % of Ce; 0.02 wt % of La; 0.04 wt % of Zr; 0.11 wt % of Sn; less than or equal to 0.01 wt % of other impurity elements; and a balance of Al.

The preparation of the die-casting aluminum alloy without heat-treatment and a die-casting process thereof in this example include the following steps:

1) Material preparation: raw materials were weighed according to the alloy composition and dried. The raw materials used include Al, Si, Mg, an Al-50Cu master alloy, an Al-5Fe master alloy, an Al-20Mn master alloy, an Al-5Ti master alloy, an Al-5Sr master alloy, an Al-10Ce master alloy, an Al-10La master alloy, an Al-5Zr master alloy and an Al-125n master alloy.
2) Smelting: a smelting furnace was heated to 750° C. to melt the Al, and then the Si, the Mg, the Al-50Cu master alloy, the Al-5Fe master alloy and the Al-20Mn master alloy were added, after these master alloys were melted, the obtained melt was transferred to a converter with a constant temperature of 730° C.; then the Al-5Ti master alloy, the Al-5Sr master alloy, the Al-10Ce master alloy, the Al-10La master alloy, the Al-5Zr master alloy and the Al-125n master alloy were added, after these master alloys were melted, high-purity nitrogen was introduced into the resulting melt, and refining agent powders were brought into the melt, ventilating for 15 minutes for degassing and deslagging. Afterwards the melt was left to stand for 12 minutes, and then transferred to a holding furnace with a constant temperature of 690° C. for pre-furnace composition analysis.
3) Die-casting: the melt with a temperature of 690° C. was transferred to an LK630T horizontal cold chamber die-casting machine for high-pressure die-casting after passing the composition test. The casting pressure is 301V1 Pa, the injection speed is 6.5 m/s, the mould temperature is 200° C., and the mould used is a flat mould with a length of 30 cm and a width of 20 cm.

Example 3

The preparation and die-casting process of the die-casting aluminum alloy without heat-treatment in this example are the same as those in Example 1, except that the die-casting aluminum alloy without heat-treatment for structural parts of the automobile body prepared in this example has the following chemical components: 6.21 wt % of Si; 0.49 wt % of Mg; 0.58 wt % of Cu; 0.18 wt % of Fe; 0.69 wt % of Mn; 0.15 wt % of Ti; 0.05 wt % of Sr; 0.05 wt % of Ce; 0.02 wt % of La; 0.04 wt % of Zr; 0.11 wt % of Sn; less than or equal to 0.01 wt % of other impurity elements; and a balance of Al.

Example 4

The preparation and die-casting process of the die-casting aluminum alloy without heat-treatment in this example are the same as those in Example 2, except that the die-casting aluminum alloy without heat-treatment for structural parts of the automobile body prepared in this example has the following chemical components: 7.92 wt % of Si; 0.49 wt % of Mg; 0.58 wt % of Cu; 0.18 wt % of Fe; 0.69 wt % of Mn; 0.15 wt % of Ti; 0.05 wt % of Sr; 0.05 wt % of Ce; 0.02 wt % of La; 0.04 wt % of Zr; 0.11 wt % of Sn; less than or equal to 0.01 wt % of other impurity elements; and a balance of Al.

Example 5

The preparation and die-casting process of the die-casting aluminum alloy without heat-treatment in this example are the same as those in Example 2, except that the die-casting aluminum alloy without heat-treatment for structural parts of the automobile body prepared in this example has the following chemical components: 7.32 wt % of Si; 0.35 wt % of Mg; 0.58 wt % of Cu; 0.18 wt % of Fe; 0.69 wt % of Mn; 0.15 wt % of Ti; 0.05 wt % of Sr; 0.05 wt % of Ce; 0.02 wt % of La; 0.04 wt % of Zr; 0.11 wt % of Sn; less than or equal to 0.01 wt % of other impurity elements; and a balance of Al.

Example 6

The preparation and die-casting process of the die-casting aluminum alloy without heat-treatment in this example are the same as those in Example 2, except that the die-casting aluminum alloy without heat-treatment for structural parts of the automobile body prepared in this example has the following chemical components: 7.32 wt % of Si; 0.49 wt % of Mg; 0.40 wt % of Cu; 0.18 wt % of Fe; 0.69 wt % of Mn; 0.15 wt % of Ti; 0.05 wt % of Sr; 0.05 wt % of Ce; 0.02 wt % of La; 0.04 wt % of Zr; 0.11 wt % of Sn; less than or equal to 0.01 wt % of other impurity elements; and a balance of Al.

Example 7

The preparation and die-casting process of the die-casting aluminum alloy without heat-treatment in this example are the same as those in Example 2, except that the die-casting aluminum alloy without heat-treatment for structural parts of the automobile body prepared in this example has the following chemical components: 7.32 wt % of Si; 0.49 wt % of Mg; 0.40 wt % of Cu; 0.28 wt % of Fe; 0.69 wt % of Mn; 0.15 wt % of Ti; 0.05 wt % of Sr; 0.05 wt % of Ce; 0.02 wt % of La; 0.04 wt % of Zr; 0.15 wt % of Sn; less than or equal to 0.01 wt % of other impurity elements; and a balance of Al.

Example 8

The preparation and die-casting process of the die-casting aluminum alloy without heat-treatment in this example are the same as those in Example 2, except that the die-casting aluminum alloy without heat-treatment for structural parts of the automobile body prepared in this example has the following chemical components: 7.32 wt % of Si; 0.49 wt % of Mg; 0.58 wt % of Cu; 0.18 wt % of Fe; 0.69 wt % of Mn; 0.15 wt % of Ti; 0.05 wt % of Sr; 0.05 wt % of Ce; 0.02 wt % of La; 0.04 wt % of Zr; 0.20 wt % of Sn; less than or equal to 0.01 wt % of other impurity elements; and a balance of Al.

Example 9

The preparation and die-casting process of the die-casting aluminum alloy without heat-treatment in this example are the same as those in Example 1, except that the die-casting machine used in this example is a Haitian Metal HDC8800T super-large intelligent die-casting machine, and the mould used is an integrated die-casting rear floor mould for the new energy automobile with a transverse beam length of 2.0 m, and a longitudinal beam length of 1.4 m. A part of the transverse beam is taken for tensile test and bending test.

Example 10

The preparation and die-casting process of the die-casting aluminum alloy without heat-treatment in this example are the same as those in Example 2, except that the die-casting machine used in this example is a Haitian Metal HDC8800T super-large intelligent die-casting machine, and the mould used is an integrated die-casting rear floor mould for the new energy automobile with a transverse beam length of 2.0 m, and a longitudinal beam length of 1.4 m. A part of the transverse beam is taken for tensile test and bending test.

Comparative Example 1

The die-casting aluminum alloy without heat-treatment for structural parts of the automobile body prepared in this comparative example has the following chemical components: 7.32 wt % of Si; 0.49 wt % of Mg; 0.58 wt % of Cu; 0.18 wt % of Fe; 0.69 wt % of Mn; 0.05 wt % of Sr; 0.05 wt % of Ce; 0.02 wt % of La; less than or equal to 0.01 wt % of other impurity elements; and a balance of Al.

The preparation and die-casting process of the die-casting aluminum alloy without heat-treatment in this comparative example are the same as those in Example 1, except that the Al-5Ti master alloy and the Al-5Zr master alloy are not added during the preparation process.

Comparative Example 2

The die-casting aluminum alloy without heat-treatment for structural parts of the automobile body prepared in this comparative example has the following chemical components: 7.32 wt % of Si; 0.49 wt % of Mg; 0.58 wt % of Cu; 0.18 wt % of Fe; 0.69 wt % of Mn; 0.15 wt % of Ti; 0.05 wt % of Ce; 0.02 wt % of La; less than or equal to 0.01 wt % of other impurity elements; and a balance of Al.

The preparation and die-casting process of the die-casting aluminum alloy without heat-treatment in this comparative example are the same as those in Example 1, except that the Al-5 Sr master alloy and the Al-5Zr master alloy are not added during the preparation process.

Comparative Example 3

The die-casting aluminum alloy without heat-treatment for structural parts of the automobile body prepared in this comparative example has the following chemical components: 7.32 wt % of Si; 0.49 wt % of Mg; 0.58 wt % of Cu; 0.18 wt % of Fe; 0.69 wt % of Mn; 0.15 wt % of Ti; 0.05 wt % of Sr; less than or equal to 0.01 wt % of other impurity elements; and a balance of Al.

The preparation and die-casting process of the die-casting aluminum alloy without heat-treatment in this comparative example are the same as those in Example 1, except that the Al-10Ce master alloy, the Al-10La master alloy and the Al-5Zr master alloy are not added during the preparation process.

Comparative Example 4

The die-casting aluminum alloy without heat-treatment for structural parts of the automobile body prepared in this comparative example has the following chemical components: 7.32 wt % of Si; 0.49 wt % of Mg; 0.58 wt % of Cu; 0.18 wt % of Fe; 0.69 wt % of Mn; 0.15 wt % of Ti; 0.05 wt % of Sr; 0.05 wt % of Ce; 0.02 wt % of La; less than or equal to 0.01 wt % of other impurity elements; and a balance of Al.

The preparation and die-casting process of the die-casting aluminum alloy without heat-treatment in this comparative example are the same as those in Example 1, except that the Al-5Zr master alloy is not added during the preparation process.

Comparative Example 5

The die-casting aluminum alloy without heat-treatment for structural parts of the automobile body prepared in this comparative example has the following chemical components: 7.32 wt % of Si; 0.49 wt % of Mg; 0.58 wt % of Cu; 0.18 wt % of Fe; 0.69 wt % of Mn; 0.15 wt % of Ti; 0.05 wt % of Sr; 0.05 wt % of Ce; 0.02 wt % of La; 0.12 wt % of Zr; less than or equal to 0.01 wt % of other impurity elements; and a balance of Al.

The preparation and die-casting process of the die-casting aluminum alloy without heat-treatment in this comparative example are the same as those in Example 1.

Comparative Example 6

The die-casting aluminum alloy without heat-treatment for structural parts of the automobile body prepared in this comparative example has the following chemical components: 7.32 wt % of Si; 0.25 wt % of Mg; 0.25 wt % of Cu; 0.18 wt % of Fe; 0.69 wt % of Mn; 0.15 wt % of Ti; 0.05 wt % of Sr; 0.05 wt % of Ce; 0.02 wt % of La; 0.04 wt % of Zr; less than or equal to 0.01 wt % of other impurity elements; and a balance of Al.

The preparation and die-casting process of the die-casting aluminum alloy without heat-treatment in this comparative example are the same as those in Example 1.

Comparative Example 7

The die-casting aluminum alloy without heat-treatment for structural parts of the automobile body prepared in this comparative example has the following chemical components: 7.32 wt % of Si; 0.49 wt % of Mg; 0.58 wt % of Cu; 0.18 wt % of Fe; 0.4 wt % of Mn; 0.15 wt % of Ti; 0.05 wt % of Sr; 0.05 wt % of Ce; 0.02 wt % of La; 0.04 wt % of Zr; less than or equal to 0.01 wt % of other impurity elements; and a balance of Al.

The preparation and die-casting process of the die-casting aluminum alloy without heat-treatment in this comparative example are the same as those in Example 1.

Comparative Example 8

The die-casting aluminum alloy without heat-treatment for structural parts of the automobile body prepared in this comparative example has the following chemical components: 5.65 wt % of Si; 0.49 wt % of Mg; 0.58 wt % of Cu; 0.18 wt % of Fe; 0.69 wt % of Mn; 0.15 wt % of Ti; 0.05 wt % of Sr; 0.05 wt % of Ce; 0.02 wt % of La; 0.04 wt % of Zr; less than or equal to 0.01 wt % of other impurity elements; and a balance of Al.

The preparation and die-casting process of the die-casting aluminum alloy without heat-treatment in this comparative example are the same as those in Example 1.

Table 1 shows the composition of the die-casting aluminum alloys prepared in Examples 1-10 and Comparative Examples 1-8.

TABLE 1

| Group | Type of mould | Si | Mg | Cu | Fe | Mn | Ti | Sr | Ce | La | Zr | Sn |
|---|---|---|---|---|---|---|---|---|---|---|---|---|
| E1 | Plate mould | 7.32 | 0.49 | 0.58 | 0.18 | 0.69 | 0.15 | 0.05 | 0.05 | 0.02 | 0.04 | / |
| E2 | Plate mould | 7.32 | 0.49 | 0.58 | 0.18 | 0.69 | 0.15 | 0.05 | 0.05 | 0.02 | 0.04 | 0.11 |
| E3 | Plate mould | 6.21 | 0.49 | 0.58 | 0.18 | 0.69 | 0.15 | 0.05 | 0.05 | 0.02 | 0.04 | / |
| E4 | Plate mould | 7.92 | 0.49 | 0.58 | 0.18 | 0.69 | 0.15 | 0.05 | 0.05 | 0.02 | 0.04 | 0.11 |
| E5 | Plate mould | 7.32 | 0.35 | 0.58 | 0.18 | 0.69 | 0.15 | 0.05 | 0.05 | 0.02 | 0.04 | 0.11 |
| E6 | Plate mould | 7.32 | 0.49 | 0.40 | 0.18 | 0.69 | 0.15 | 0.05 | 0.05 | 0.02 | 0.04 | 0.11 |
| E7 | Plate mould | 7.32 | 0.49 | 0.40 | 0.28 | 0.69 | 0.15 | 0.05 | 0.05 | 0.02 | 0.04 | 0.15 |
| E8 | Plate mould | 7.32 | 0.49 | 0.58 | 0.18 | 0.69 | 0.15 | 0.05 | 0.05 | 0.02 | 0.04 | 0.20 |
| E9 | Transverse beam of die-casting rear floor mould | 7.32 | 0.49 | 0.58 | 0.18 | 0.69 | 0.15 | 0.05 | 0.05 | 0.02 | 0.04 | / |
| E10 | Transverse beam of die-casting rear floor mould | 7.32 | 0.49 | 0.58 | 0.18 | 0.69 | 0.15 | 0.05 | 0.05 | 0.02 | 0.04 | 0.11 |
| CE1 | Plate mould | 7.32 | 0.49 | 0.58 | 0.18 | 0.69 | / | 0.05 | 0.05 | 0.02 | / | / |
| CE2 | Plate mould | 7.32 | 0.49 | 0.58 | 0.18 | 0.69 | 0.15 | / | 0.05 | 0.02 | / | / |
| CE3 | Plate mould | 7.32 | 0.49 | 0.58 | 0.18 | 0.69 | 0.15 | 0.05 | / | / | / | / |
| CE4 | Plate mould | 7.32 | 0.49 | 0.58 | 0.18 | 0.69 | 0.15 | 0.05 | 0.05 | 0.02 | / | / |
| CE5 | Plate mould | 7.32 | 0.49 | 0.58 | 0.18 | 0.69 | 0.15 | 0.05 | 0.05 | 0.02 | 0.12 | / |
| CE6 | Plate mould | 7.32 | 0.25 | 0.25 | 0.18 | 0.69 | 0.15 | 0.05 | 0.05 | 0.02 | 0.04 | / |
| CE7 | Plate mould | 7.32 | 0.49 | 0.58 | 0.18 | 0.40 | 0.15 | 0.05 | 0.05 | 0.02 | 0.04 | / |
| CE8 | Plate mould | 5.65 | 0.49 | 0.58 | 0.18 | 0.69 | 0.15 | 0.05 | 0.05 | 0.02 | 0.04 | / |

Test Example 1

The aluminum alloy castings prepared in Examples 1-10 and Comparative Examples 1-8 were tested for mechanical properties, and the aluminum alloy castings prepared in Examples 9-10 were subjected to a bending test. The results are shown in Table 2.

TABLE 2

| Alloy No. | Type of mould | Tensile strength MPa | Yield strength MPa | Elongation % | Bending angle ° |
|---|---|---|---|---|---|
| E1 | Plate mould | 321 | 162 | 15.1 | / |
| E2 | Plate mould | 342 | 174 | 15.8 | / |
| E3 | Plate mould | 312 | 154 | 15.5 | / |
| E4 | Plate mould | 326 | 164 | 13.7 | / |
| E5 | Plate mould | 303 | 152 | 16.4 | / |
| E6 | Plate mould | 301 | 152 | 15.3 | / |
| E7 | Plate mould | 317 | 158 | 12.1 | / |
| E8 | Plate mould | 335 | 156 | 10.1 | / |
| E9 | Longitudinal beam of die-casting rear floor mould | 312 | 157 | 13.7 | 24.6 |
| E10 | Longitudinal beam of die-casting rear floor mould | 316 | 159 | 15.2 | 27.0 |
| CE1 | Plate mould | 299 | 148 | 12.6 | / |
| CE2 | Plate mould | 285 | 152 | 11.5 | / |
| CE3 | Plate mould | 275 | 125 | 12.3 | / |
| CE4 | Plate mould | 306 | 151 | 13.0 | / |
| CE5 | Plate mould | 301 | 143 | 12.6 | / |
| CE6 | Plate mould | 263 | 128 | 14.3 | / |
| CE7 | Plate mould | 258 | 122 | 8.4 | / |
| CE8 | Plate mould | 245 | 115 | 19.8 | / |

It can be seen from Table 2 that the tensile strength and the yield strength of the aluminum alloy castings prepared in examples of the present are significantly improved, especially those die-casting aluminum alloys which are added with Zr and Sn and have the same addition amounts of other components, whose tensile strength, yield strength and elongation are significantly enhanced.

Test Example 2

The microstructure of the aluminum alloy castings prepared in Examples 1 and 2 was observed. The results are shown in FIG. 2.

Figure 2:
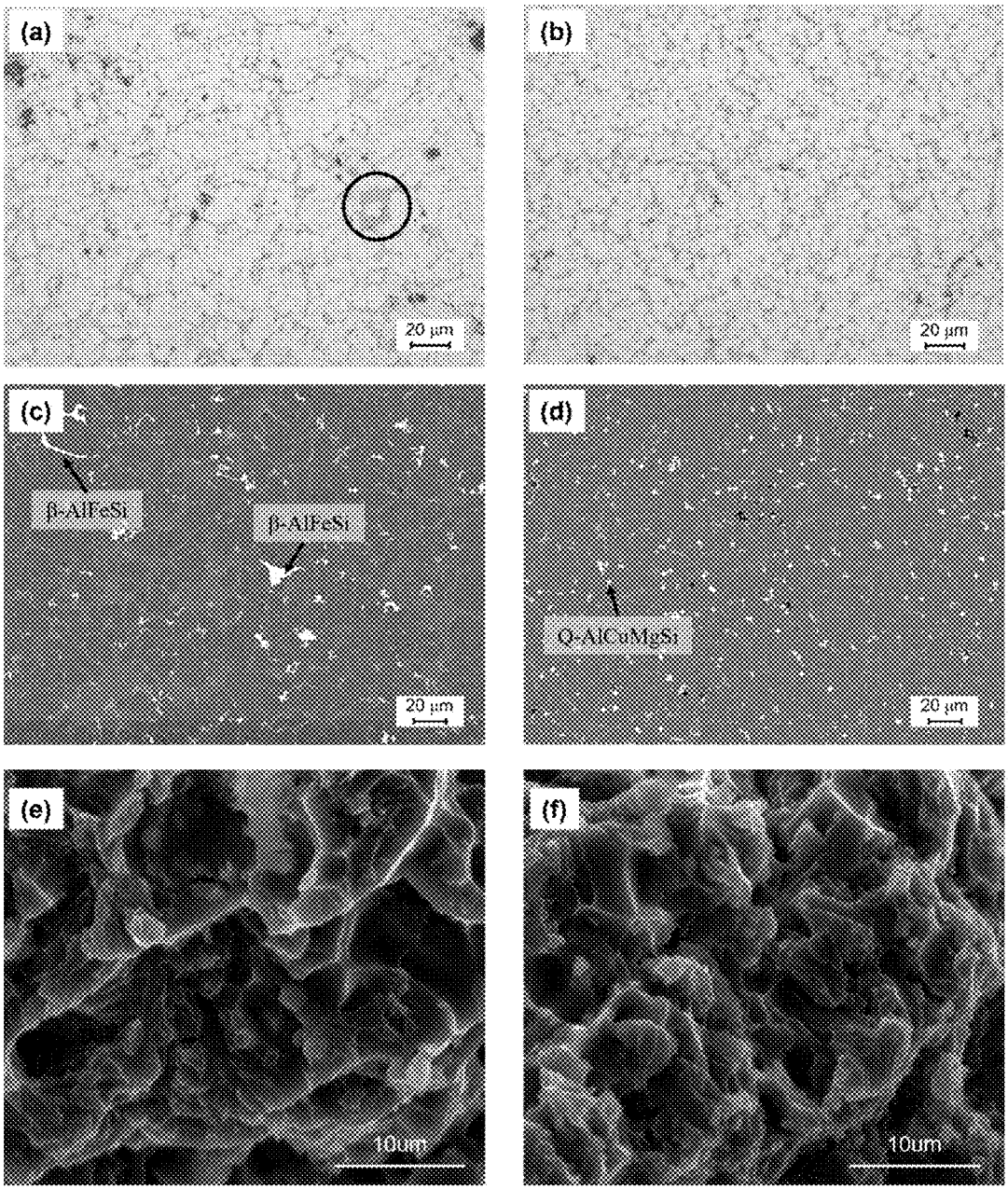
FIG. 2 shows microstructure images of aluminum alloy castings prepared in Example 1 and Example 2 of the present disclosure; where images (a), (c) and (e) in FIG. 2 are microstructure images of the aluminum alloy casting prepared in Example 1, images (b), (d) and (f) in FIG. 2 are microstructure images of the aluminum alloy casting prepared in Example 2; the images (a) and (b) in FIG. 2 are optical micrographs, the images (c) and (d) in FIG. 2 are electron micrographs, and the images (e) and (f) in FIG. 2 are fracture morphology.
Figure 3:
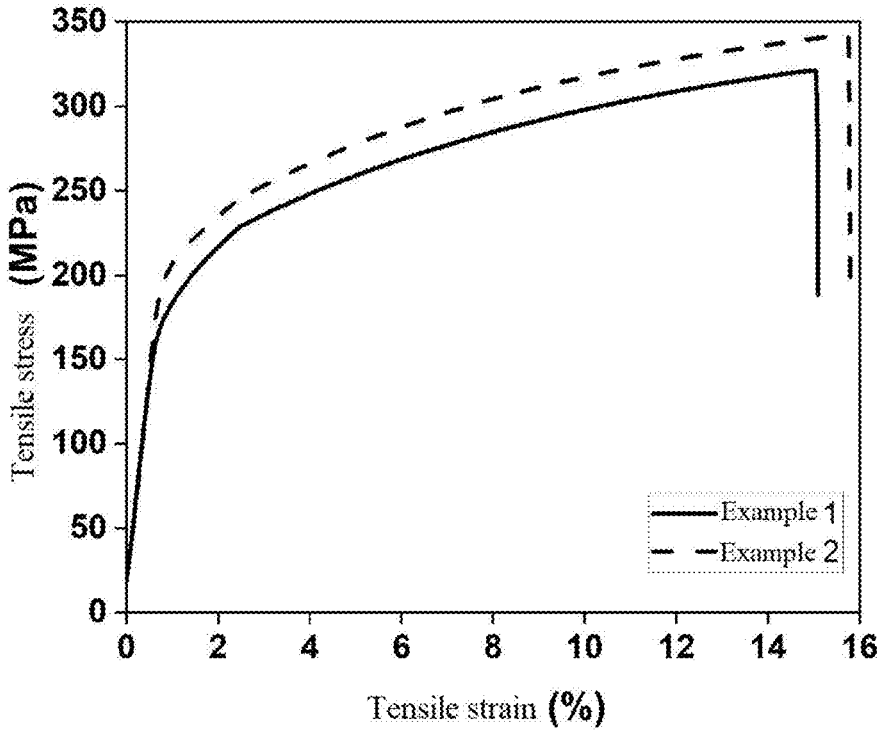
FIG. 3 shows stress-strain curves of aluminum alloy castings prepared in Example 1 and Example 2 of the present disclosure.
Figure 4:
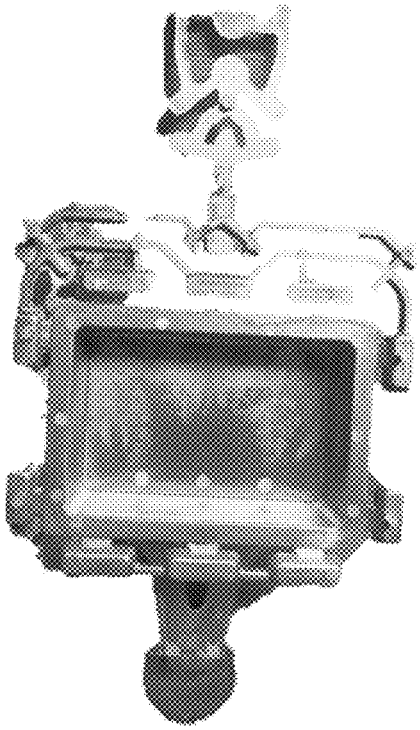
FIG. 4 shows a flat mould sample in embodiments of the present disclosure.

Through the optical micrographs (images (a) and (b) in FIG. 2), it is found that the addition of Sn can further refine the size of primary a-Al in the alloy, this is because the fine heterogeneous nucleation particles formed due to the addition of Sn in the alloy achieve the effect of grain refinement. From the electron micrographs (images (c) and (d) in FIG. 2), it is found that the alloy has coarse needle-like β-AlFeSi phase without the addition of Sn; when Sn is added to the alloy, the needle-like β-AlFeSi phase in the alloy almost completely disappears. Further through the fracture electron micrographs (mages (e) and (f) in FIG. 2), it is found that the fracture of the alloy is almost brittle fracture without the addition of Sn, but when Sn is added, there are relatively fine dimples in the fracture morphology of the alloy.

Other embodiments of the present disclosure will be apparent to those skilled in the art from consideration of the specification and practice of the present disclosure disclosed here. The present disclosure is intended to cover any variations, uses, or adaptations of the present disclosure following the general principles thereof and including such departures from the present disclosure as come within known or customary practice in the art. It is intended that the specification and examples be considered as illustrative only, with a true scope and spirit of the present disclosure being indicated by the following claims.

It will be appreciated that the present disclosure is not limited to the exact construction that has been described above and illustrated in the accompanying drawings, and that various modifications and changes can be made without departing from the scope thereof. It is intended that the scope of the present disclosure only be limited by the appended claims.

What is claimed is:

1. An aluminum alloy, based on total weight of the aluminum alloy, the aluminum alloy comprising:

6.0 to 8.0 wt % of Si;
0.3 to 1.2 wt % of Mg;
0.4 to 0.8wt % of Cu;
0.1 to 0.3 wt % of Fe;
0.6 to 0.8 wt % of Mn;
0.05 to 0.20 wt % of Ti;
0.03 to 0.07 wt % of Sr;
0.03 to 0.07 wt % of Ce;
0.01 to 0.04 wt % of La;
0.01 to 0.1 wt % of Zr;
less than or equal to 0.01 wt % of other impurity elements; and
a balance of Al.

2. The aluminum alloy of claim 1, wherein based on the total weight of the aluminum alloy, the aluminum alloy comprises:

6.0 to 8.0 wt % of Si;
0.3 to 0.9 wt % of Mg;
0.4 to 0.8 wt % of Cu;
0.1 to 0.3 wt % of Fe;
0.65 to 0.75 wt % of Mn;
0.05 to 0.20 wt % of Ti;
0.03 to 0.07 wt % of Sr;
0.03 to 0.07 wt % of Ce;
0.01 to 0.04 wt % of La;
0.01 to 0.1 wt % of Zr;
less than or equal to 0.01 wt % of other impurity elements; and
a balance of Al.

3. The aluminum alloy of claim 1, wherein based on the total weight of the aluminum alloy, the aluminum alloy comprises:

6.0 to 8.0 wt % of Si;
0.3 to 1.2 wt % of Mg;
0.4 to 0.58 wt % of Cu;
0.1 to 0.3 wt % of Fe;
0.6 to 0.75 wt % of Mn;
0.05 to 0.20 wt % of Ti;
0.03 to 0.07 wt % of Sr;
0.03 to 0.07 wt % of Ce;
0.01 to 0.04 wt % of La;
0.01 to 0.1 wt % of Zr;
less than or equal to 0.01 wt % of other impurity elements; and
a balance of Al.

4. The aluminum alloy of claim 1, wherein based on the total weight of the aluminum alloy, the aluminum alloy comprises:

6.0 to 8.0 wt % of Si;
0.3 to 0.9 wt % of Mg;
0.4 to 0.58 wt % of Cu;
0.1 to 0.3 wt % of Fe;
0.65 to 0.69 wt % of Mn;
0.05 to 0.20 wt % of Ti;
0.03 to 0.07 wt % of Sr;
0.03 to 0.07 wt % of Ce;
0.01 to 0.04 wt % of La;
0.01 to 0.1 wt % of Zr;
less than or equal to 0.01 wt % of other impurity elements; and
a balance of Al.

5. The aluminum alloy of claim 1, further comprising 0.05 to 0.15 wt % of Sn based on the total weight of the aluminum alloy.

6. The aluminum alloy of claim 5, wherein in the aluminum alloy, mass ratio of Sn to Fe is not greater than 1.0, mass ratio of Mn to Fe is not less than 3.0, and mass ratio of Ce to La is not less than 2.0.

7. The aluminum alloy of claim 1, wherein the aluminum alloy has an ultimate tensile strength of 300 to 350 MPa, a yield strength of 150 to 180 MPa, an elongation at break of 11.0 to 16.0%, and a bending angle of 23.0 to 27.0° at a section thickness of 3.2 mm.

8. A method for preparing an aluminum alloy of claim 1, comprising:

melting aluminum in a smelting furnace, adding thereto silicon, magnesium, a Cu raw material, a Fe raw material and an Mn raw material, and performing first smelting to obtain a first melt;

transferring the first melt to a converter after the first melt is cooled down, adding a first material at a bottom of the first melt, and performing second smelting and first degassing, refining and deslagging to obtain a second melt;

transferring the second melt to a holding furnace for component testing after the second melt is cooled down, and performing high-pressure die-casting on the second melt qualified after the component testing to obtain the aluminum alloy;

wherein the first material comprises a Ti raw material, a Sr raw material, a Ce raw material, a La raw material, a Zr raw material and a Sn raw material, or the first material comprises the Ti raw material, the Sr raw material, the Ce raw material, the La raw material and the Zr raw material.

9. The method of claim 8, wherein the Cu raw material is an Al—Cu alloy; the Fe raw material is an Al—Fe alloy; the Mn raw material is an Al—Mn alloy; the Ti raw material is an Al—Ti alloy; the Sr raw material is an Al—Sr alloy; the Ce raw material is an Al—Ce alloy; the La raw material is an Al—La alloy; the Zr raw material is an Al—Zr alloy; and the Sn raw material is an Al—Sn alloy.

10. The method of claim 9, wherein the Al—Cu alloy is an Al-50Cu master alloy; the Al—Fe alloy is an Al-5Fe master alloy; the Al—Mn alloy is an Al-20Mn master alloy; the Al—Ti alloy is an Al-5Ti master alloy; the Al—Sr alloy is an Al-5Sr master alloy; the Al—Ce alloy is an Al-10Ce master alloy; the Al—La alloy is an Al-10La master alloy; the Al—Zr alloy is an Al-5Zr master alloy; and the Al—Sn alloy is an Al-12Sn master alloy.

11. The method of claim 9, wherein based on the total weight of the aluminum alloy, the aluminum alloy comprises:

6.0 to 8.0 wt % of Si;
0.3 to 1.2 wt % of Mg;
0.4 to 0.58 wt % of Cu;
0.1 to 0.3 wt % of Fe;
0.6 to 0.75 wt % of Mn;
0.05 to 0.20 wt % of Ti;
0.03 to 0.07 wt % of Sr;
0.03 to 0.07 wt % of Ce;
0.01 to 0.04 wt % of La;
0.01 to 0.1 wt % of Zr;
less than or equal to 0.01 wt % of other impurity elements; and
a balance of Al.

12. The method of claim 9, wherein based on the total weight of the aluminum alloy, the aluminum alloy comprises:

6.0 to 8.0 wt % of Si;
0.3 to 0.9 wt % of Mg;
0.4 to 0.58 wt % of Cu;
0.1 to 0.3 wt % of Fe;
0.65 to 0.69 wt % of Mn;
0.05 to 0.20 wt % of Ti;
0.03 to 0.07 wt % of Sr;
0.03 to 0.07 wt % of Ce;
0.01 to 0.04 wt % of La;
0.01 to 0.1 wt % of Zr;
less than or equal to 0.01 wt % of other impurity elements; and
a balance of Al.

13. The method of claim 8, wherein a smelting temperature of the smelting furnace is 740 to 760° C.;
a transfer temperature of the converter is 710 to 730° C.; and
a holding temperature of the holding furnace is 690 to 710° C.

14. The method of claim 8, wherein the first degassing, refining and deslagging comprises:

adding refining agent powders into a furnace body of the converter under an atmosphere of an inert gas or nitrogen, the inert gas being argon.

15. The method of claim 8, wherein a condition of the high-pressure comprises: a pressure of 26 to 70 MPa, an injection speed of 5.5 to 7.0 m/s, and a die casting-temperature of 690 to 710° C.

16. The method of claims 8, further comprising:

drying the aluminum, the silicon, the magnesium, the Cu raw material, the Fe raw material, the Mn raw material, the Ti raw material, the Sr raw material, the Ce raw material, the La raw material, the Zr raw material and the Sn raw material before the melting or the smelting steps, wherein the drying is performed at a temperature of 150 to 200° C.

17. A structural part of an automobile body, comprising an aluminum alloy, wherein the aluminum alloy comprises:

6.0 to 8.0 wt % of Si;
0.3 to 1.2 wt % of Mg;
0.4 to 0.8 wt % of Cu;
0.1 to 0.3 wt % of Fe;
0.6 to 0.8 wt % of Mn;
0.05 to 0.20 wt % of Ti;
0.03 to 0.07 wt % of Sr;
0.03 to 0.07 wt % of Ce;
0.01 to 0.04 wt % of La;
0.01 to 0.1 wt % of Zr;
less than or equal to 0.01 wt % of other impurity elements; and
a balance of Al.

18. The structural part of the automobile body of claim 17, wherein based on the total weight of the aluminum alloy, the aluminum alloy comprises:

6.0 to 8.0 wt % of Si;
0.3 to 0.9 wt % of Mg;
0.4 to 0.8 wt % of Cu;
0.1 to 0.3 wt % of Fe;
0.65 to 0.75 wt % of Mn;
0.05 to 0.20 wt % of Ti;
0.03 to 0.07 wt % of Sr;
0.03 to 0.07 wt % of Ce;
0.01 to 0.04 wt % of La;
0.01 to 0.1 wt % of Zr;
less than or equal to 0.01 wt % of other impurity elements; and
a balance of Al.

19. The structural part of the automobile body of claim 17, wherein based on the total weight of the aluminum alloy, the aluminum alloy comprises:

6.0 to 8.0 wt % of Si;
0.3 to 1.2 wt % of Mg;
0.4 to 0.58 wt % of Cu;
0.1 to 0.3 wt % of Fe;
0.6 to 0.75 wt % of Mn;
0.05 to 0.20 wt % of Ti;
0.03 to 0.07 wt % of Sr;
0.03 to 0.07 wt % of Ce;
0.01 to 0.04 wt % of La;
0.01 to 0.1 wt % of Zr;
less than or equal to 0.01 wt % of other impurity elements; and
a balance of Al.

20. The structural part of the automobile body of claim 17, wherein based on the total weight of the aluminum alloy, the aluminum alloy comprises:

6.0 to 8.0 wt % of Si;
0.3 to 0.9 wt % of Mg;
0.4 to 0.58 wt % of Cu;
0.1 to 0.3 wt % of Fe;
0.65 to 0.69 wt % of Mn;
0.05 to 0.20 wt % of Ti;
0.03 to 0.07 wt % of Sr;
0.03 to 0.07 wt % of Ce;
0.01 to 0.04 wt % of La;
0.01 to 0.1 wt % of Zr;
less than or equal to 0.01 wt % of other impurity elements; and
a balance of Al.

* * * * *